United States Patent [19]

Croucher et al.

[11] Patent Number: 4,764,446

[45] Date of Patent: Aug. 16, 1988

[54] LIQUID DEVELOPER COMPOSITIONS WITH HIGH TRANSFER EFFICIENCY

[75] Inventors: Melvin D. Croucher, Oakville; George R. Pravato, York; John R. C. Fuller, Oakville; James M. Duff, Mississauga, all of Canada

[73] Assignee: Xerox Corporation, Stamford, Conn.

[21] Appl. No.: 14,571

[22] Filed: Feb. 12, 1987

[51] Int. Cl.[4] ..... G03G 9/12

[52] U.S. Cl. ..... 430/115; 430/119

[58] Field of Search ..... 430/114, 115, 116, 137, 430/119

[56] References Cited

U.S. PATENT DOCUMENTS

| | | | |
|---|---|---|---|
| 3,844,966 | 10/1974 | Nelson | 252/62.1 |
| 3,985,663 | 10/1976 | Lu et al. | 430/115 |
| 4,473,629 | 9/1984 | Herrmann et al. | 430/116 |
| 4,474,621 | 10/1984 | Croucher et al. | 430/114 |

FOREIGN PATENT DOCUMENTS

| | | |
|---|---|---|
| 3114428 | 10/1978 | Japan . |
| 1537211 | 12/1978 | United Kingdom . |

*Primary Examiner*—John L. Goodrow

[57] ABSTRACT

Disclosed is a liquid developer composition comprised of an oil base selected from the group consisting of Magiesol and Isopar, pigment particles, a stabilizer, and a surfactant that enables flocculation of the developer components, and efficient wetting of the photoreceptor surface.

27 Claims, No Drawings

LIQUID DEVELOPER COMPOSITIONS WITH HIGH TRANSFER EFFICIENCY

BACKGROUND OF THE INVENTION

This invention is generally directed to liquid developer compositions, especially liquid developers with superior transfer efficiencies. More specifically, the present invention is directed to liquid developer compositions comprised of an oil base, pigment particles, black or colored, a stabilizer, and additive components, such as Nuodex Copper Napthenate available from Nuodex Canada Ltd., Sulframin 1298, and Witcamine AL-42, which is commercially available from Witco Chemical Corporation. These additive components assist in both flocculation of the developer compositions, and in wetting of the photoreceptor surface selected. Thus, in one important embodiment of the present invention there are provided liquid inks with acceptable drying times, and excellent transfer efficiencies (percent by weight of the ink composition developed on the photoreceptor and transferred, for example, to paper) of 80 percent or greater, which inks are comprised of oil bases such as Magiesol, pigment particles, a stabilizer component, and as an additive for flocculation of the developer and wetting of the photoreceptor surface surfactants, such as Sulframin 1298, Witcamine AL-42, and Nuodex Copper Napthenate, or mixtures thereof. In a further embodiment of the present invention, there are provided liquid ink compositions comprised of an oil component of, for example, Magiesol or Isopar, pigment particles comprised of black or colored components, inclusive of cyan, magenta, and yellow; a stabilizer component; and as an additive for flocculation of the developer, surfactants such as Sulframin 1298, Witcamine AL-42, and Nuodex Copper Napthenate. The liquid inks of the present invention can be selected for the development of images in various processes, including the liquid development process as described in U.S. Pat. No. 3,084,043, the disclosure of which is totally incorporated herein by reference, xerographic processes, electrographic recording, electrostatic printing, and facsimile systems. In addition, it is known that with traditional lithographic printers there results an ink splitting phenomenon between the printing press and the paper causing unusually low image transfer efficiencies of, for example, less than 60 percent. With the ink compositions of the present invention, this ink splitting phenomenon is substantially reduced enabling transfer efficiencies of 80 percent or greater.

Liquid developer compositions are known, reference for example U.S. Pat. No. 3,806,354, the disclosure of which is totally incorporated herein by reference. This patent illustrates liquid inks comprised of one or more liquid vehicles, colorants, such as pigments, and dyes, dispersants, and viscosity control additives. Examples of vehicles disclosed in the aforementioned patent are mineral oils, mineral spirits, and kerosene; while examples of colorants include carbon black, oil red, and oil blue. Dispersants described in this patent include materials such as an alkylated polyvinyl pyrrolidone. Additionally, there is described in U.S. Pat. No. 4,476,210, the disclosure of which is totally incorporated herein by reference, liquid ink immersion developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history, and evolution of liquid developers is provided in the '210 patent, reference columns 1 and 2 thereof.

In addition, there is illustrated in U.S. Pat. No. 3,844,966 liquid toner compositions comprised of a carrier liquid with toner particles suspended therein, and a trivalent or tetravalent metal salt of an organic acid, and an organic amine dissolved in the carrier liquid, reference for example the Abstract of the Disclosure. British Patent Publication No. 1,537,211 is directed to aqueous printing inks with improved transfer efficiencies, which inks contain, for example, polyethylene oxides of a molecular weight of from about 100,000 to 350,000; while Japanese Patent Publication discloses electrophotographic liquid developers containing lecithin in an organic amine, reference the Abstract of the Disclosure. The aforementioned prior art, however, does not teach liquid developer compositions as illustrated in the present invention wherein, for example, there is selected a stabilizer and additive components such as Nuodex, which components enable the flocculation of the developer compositions, for example, and thereby provide for improved transfer efficiencies of the image developed.

Although the above described prior art liquid inks are suitable for their intended purposes, there remains a need for new liquid developers. More specifically, there is a need for liquid developers with improved drying times, superior transfer efficiencies, and desirable conductivity values. There also is a need for colored liquid developers which possess many of the aforementioned characteristics. Additionally, there is a need for economical liquid developer compositions that permit images of excellent resolution in a number of known imaging processes, including those illustrated in U.S. Pat. No. 3,084,043, the disclosure of which is totally incorporated herein by reference. Moreover, there is a need for liquid developers wherein the colorants selected are suitably dispersed such that the primary particles are of an average diameter of from 0.1 micron to about 5 microns thereby enabling black, or colored images of excellent resolution. Further, there remains a need for liquid developers wherein there is included therein certain additives that enable flocculation of the developer, and wetting of the photoreceptor surface thus permitting transfer efficiencies of 80 percent or greater. There also is a need for liquid inks which are useful with dielectric papers. In addition, there is a need for developers having incorporated therein viscosity additives such as soluble polymers or viscosity modifiers such as clays and silicas permitting inks with a preferred viscosity of from about 200 to about 300 centipoises, which viscosities are not time dependent as is the situation with known thixotropic inks. Furthermore, there is a need for ink compositions with a preferred resisitivity not exceeding $10^{11}$ ohm-cm. Accordingly, there is a need for ink compositions with a resistivity of from about $10^{9}$ to about $10^{11}$ ohm-cm thereby preventing image distortion. Additionally, there is a need for ink compositions that are conductive, can be easily cleaned from the photoreceptor surface, will wet the photoreceptor surface and the gravure roll containing the ink; possess extended shelf life, for example about 18 months, which inks are further free of environmentally hazardous materials. These and other needs are obtainable with the ink compositions of the present invention.

SUMMARY OF THE INVENTION

It is an object of the present invention to provide improved liquid developer compositions.

In another object of the present invention there are provided black and colored liquid developer compositions which can be selected for use in several different imaging systems, and which inks may also be used with dielectric papers in certain situations.

In yet another object of the present invention there are provided liquid developer compositions with rapid drying times, and superior transfer efficiencies.

It is an additional object of the present invention to provide liquid developer compositions with transfer efficiencies of 80 percent or greater.

Furthermore, in another object of the present invention there are provided liquid developer compositions with cyan, magenta, or yellow pigments.

Another object of the present invention resides in liquid developer compositions with viscosity control additives.

In still another object of the present invention there are provided ink compositions with viscosities of from about 100 to about 1,000 centipoises, and preferably from about 200 to about 350 centipoises.

Additionally, in another object of the present invention there are provided ink compositions with extended shelf life, and wherein these inks are free of environmental hazards.

In addition, in another object of the present invention there are provided ink compositions that can be readily cleaned from photoreceptor surfaces, especially since less ink is present on these surfaces subsequent to transfer; and wherein the inks can be dried by the absorption of the base oil into the paper, or by the evaporation of these oils.

Moreover, there is a need for ink compositions that possess acceptable resistivities of, for example, from about $10^9$ to about $10^{11}$ ohm-cm.

These and other objects of the present invention are accomplished by providing certain liquid developer compositions. More specifically, in one embodiment the present invention is directed to liquid developer compositions with transfer efficiencies of 80 percent or greater, comprised of an oil base component of Magiesol 60 or Isopar; black or colored pigment particles; a stabilizer or thickener component; and surfactants that assist in the desired flocculation of the developer composition components, and enables wetting of the photoreceptor surface. In one specific embodiment of the present invention, there are provided liquid developer compositions comprised of from about 30 percent to about 95 percent by weight of an oil base component illustrated herein inclusive of Magiesol 60 from about 5 percent to about 30 percent by weight of black or colored pigment particles, from about 1 to about 50 percent by weight of stabilizers inclusive of Kraton G-1701, a poly(styrene hydrogenated butadiene) block copolymer available from Shell Chemical Company; Vistanex, a polyisobutylene polymer available from Exxon Chemical Corporation; Polypale Ester 10, available from Hercules Chemical Company; Ganex V-216, an alkylated poly(vinyl pyrrolidone), available from GAF Corporation; OLOA 1200, a polyisobutylene succimide, available from Chevron Oil Company; and the like, which stabilizers can also function as viscosity control agents, from about 0.5 percent to about 5 percent by weight of surfactants selected from the group consisting of Sulframin 1298, Witcamine AL-42, and Nuodex Copper Naphthenate. The compositions of the present invention may also include therein as optional components present in an amount of from about 0.5 to about 5 weight percent pigment based viscosity control additives, such as Aerosil 200, Aerosil 300, silica pigments available from Degussa Company, and Bentone 500, a montmelliorite clay available from NL Products Company.

Examples of oil base vehicle components present in an amount of from about 30 percent by weight to about 95 percent by weight, and preferably present in an amount of from about 35 percent by weight to about 80 percent by weight, include Magiesols such as Magiesol 60 because of its low viscosity, that is for example from about 1 to about 15 centipoises. Other oils that may be substituted in certain situations for the Magiesol include Witsol 50, Isopars, Paraflex HT-10, Shellflex 210, Shellflex 270, Parabase, and the like. Also, various different forms of Isopars, which dry by evaporation, can be selected in certain situations, including Isopar G, Isopar H, Isopar K, and Isopar L, available from Exxon Chemical Corporation. Magiesol 60 is the preferred oil for the inks of the present invention primarily because of its low vapor pressure, that is for example it does not evaporate when exposed to the atmosphere which translates essentially into a zero vapor pressure at ambient temperatures, it is odorless, water white in color, and is rapidly absorbed into paper.

Examples of colorants or pigment particles present in an amount of from about 5 percent by weight to about 30 percent by weight, and preferably present in an amount of from about 6 percent by weight to about 20 percent by weight that can be selected for the developers of the present invention include carbon blacks, especially Microliths, which are believed to be resinated carbon blacks, available from BASF; Printex 140 V, available from Degussa; and Raven 5250, available from Columbian Chemicals; red, green, blue, cyan, magenta, or yellow pigments; and mixtures thereof; and other similar pigments. Illustrative examples of magenta materials that may be selected as pigments include, for example, 2,9-dimethyl-substituted quinacridone and anthraquinone pigment identified in the Color Index as CI 60710; CI Dispersed Red 15, diazo pigment identified in the Color Index as CI 26050; CI Solvent Red 19; and the like. Examples of specific cyan pigment materials include Hostaperm Pink E, Sudan Blue OS, Lithol Scarlett, and the like; copper tetra-4(octadecyl sulfonamido) phthalocyanine; X-copper phthalocyanine pigment listed in the Color Index as CI 74160; CI Pigment Blue; Anthrathrene Blue, identified in the Color Index as CI 69810; Special Blue X-2137, and the like; while illustrative examples of yellow pigments that may be selected are diarylide yellow 3,3-dichlorobenzidene acetoacetanilides, a monoazo pigment identified in the Color Index as CI 12700; CI Solvent Yellow 16, a nitrophenyl amine sulfonamide identified in the Color Index as Yellow SE/GLN; CI Dispersed Yellow 33, 2,5-dimethoxy-4-sulfonanilide phenylazo-4'-chloro-2,5-dimethoxy aceto-acetanilide; and Permanent Yellow FGL. The aforementioned pigments are incorporated into the liquid developer compositions in various suitable effective amounts providing the objectives of the present invention are achieved. In one embodiment, these colored pigment particles are present in the developer composition in an amount of from about 2 percent by weight to about 15 percent by weight calculated on the weight of the total composition. Specific examples of black Microlith pigments that may be selected are Microlith CT, and the like.

As examples of stabilizer components present in an amount of from about 1 percent to about 40 percent by weight, which components may also function as thickeners or viscosity control agents, and dispersants, there are mentioned alkylated polyvinyl pyrrolidones, such as Ganex V216, available from GAF; Vistanex, a polyisobutylene, available from Exxon Corporation; Kraton G-1701, a block copolymer of poly(styrene-b-hydrogenated butadiene) available from Shell Chemical Company; OLOA 1200, a polyisobutylene succinimide, available from Chevron Chemical Company; Polypale Ester 10, a glycol rosin ester available from Hercules Powder Company; and other similar stabilizers.

Surfactant additives present in an amount of from about 0.5 percent to about 5 percent by weight that may be selected; that enable flocculation of the developer composition components; and allow excellent wetting of the photoreceptor surface thereby permitting transfer efficiencies of from 80 to 95 percent, include the materials indicated hereinbefore such as Nuodex Copper Napthenate, available from Nuodex Canada, Inc.; Sulframin 1298; and Witcamine AL-42, available from Witco Chemical.

Other additive particles present in an amount of from about 0.5 percent to about 5 percent by weight that may be selected, and that enable the viscosity of the developers to be increased from about 100 centipoises to about 300 centipoises include, as indicated herein, pigments such as Aerosil 200, Aerosil 300, which are silica, pigments from Degussa, and Bentone 500, which is a treated montmelliorite clay available from NL Products.

Characteristics associated with the liquid developers of the present invention are illustrated hereinbefore, and include, for example, excellent drying times, less than 60 seconds in some instances; desirable particle sizes, preferably of from about 0.1 to 1 micron in diameter, thus permitting acceptable image resolutions; and further the inks of the present invention are viscostatic, that is the viscosities thereof remain unchanged by less than a plus, or minus 20 percent over a temperature range of from about 10° to about 32° C.

The ink compositions of the present invention are particularly useful in liquid development systems, such as those illustrated in the article Image Development By Electrostatic Lithography by Crowley and Till, reference the Third International Congress on Advances in Non-impact Printing Technologies, SPSE Abstracts, Pages 61 to 64, 1986, the disclosures of which are totally incorporated herein by reference. More specifically, for example, in electrostatic lithography the electrostatic latent image is generated on an inorganic photoreceptor such as selenium, or an organic photoreceptor by, for example, the selection of flash discharge for light lens imaging apparatuses; or by the utilization of laser discharge as in electronic printing processes. The latent image on the photoreceptor surface is then brought into close proximity to the ink composition of the present invention, which can reside in the grooves of a gravure roller. Initially, the ink composition fills the grooves of the roll, and thereafter it is subsequently metered by a blade to a predetermined volume. When the photoreceptor enters the development zone present in the imaging and/or printing apparatus, the conductive liquid ink composition is attracted by the electrostatic image on the photoreceptor, and thereafter this ink composition is extracted from the valleys of the gravure roll onto the photoreceptor wherein the electric forces are the strongest. Upon contacting the photoreceptor, the ink composition spreads along the surface by wetting, thereby dragging additional ink from the valleys of the gravure roller. Many advantages are associated with the aforementioned process inclusive of desirable contact of the ink with only the photoreceptor surface wherein there is present thereon an electrostatic charge pattern; and the sign or polarity of the electrostatic charge, that is negative or positive, is of no consequence since the inks which primarily possess a neutral charge thereon enable the use thereof with either positively charged or negatively charged electrostatic images. Thereafter, and subsequent to the latent image being toned, the photoreceptor is moved out of the development zone, followed by, for example, electrostatically transferring the developed image to paper. The aforementioned image is dried by absorption, evaporation, or combinations thereof of the oil based vehicles. Accordingly, one important advantage associated with the ink compositions of the present invention is their selection for the development of either positively charged or negatively charged latent images since the aforementioned inks are electrically neutral. In addition, the liquid developer compositions of the present invention are also useful for enabling the development of colored electrostatic latent images, particularly those contained on an imaging member charged positively or negatively. Examples of imaging members that may be selected are various known organic photoreceptors including layered photoreceptors. Illustrative examples of layered photoresponsive devices include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanine. Transport material examples include various diamines dispersed in resinous binders. Other organic photoresponsive materials that may be utilized in the practice of the present invention include polyvinyl carbazole, 4-dimethylamino benzylidene; 2-benzylidene-amino-carbazole; (2-nitrobenzylidene)-p-bromoaniline; 2,4-diphenyl-quinazoline; 1,2,4-triazine; 1,5-diphenyl-3-methyl pyrazoline; 2-(4'-dimethyl-amino phenyl)benzoxazole; 3-amino-carbazole; polyvinylcarbazole-tritrofluorenone charge transfer complex; and mixtures thereof. Further imaging members that can be selected are selenium and selenium alloys, zinc oxide, cardmium sulfide, hydrogenated amorphous silicon, as well as iongraphic surfaces of various dielectric materials such as polycarbonate polysulfone fluoropolymers, anodized aluminum alone or filled with wax expanded fluoropolymers.

The following examples are being supplied to further define specific embodiments of the present invention, it being noted that these examples are intended to illustrate and not limit the scope of the present invention. Parts and percentages are by weight unless otherwise indicated.

With respect to the following examples the imaging tests were accomplished on an imaging breadboard wherein the photoreceptor was comprised of a supporting substrate of aluminum, a photogenerating layer of trigonal selenium, 90 percent, dispersed in a polyvinyl carbazole resinous binder, 10 percent, and a charge transport layer containing N,N'-diphenyl-N,N-bis(3-methylphenyl)1,1'-biphenyl-4,4'-diamine, 55 percent by weight dispersed in 45 percent by weight of a polycarbonate resin. The gravure roll selected was comprised of stainless steel and contained 200 grooves per inch with the depth of the grooves being approximately 40 microns. Additionally, the latent images on the aforementioned photoreceptor were formulated as illustrated in the prior art, reference for example U.S. Pat. No. 4,265,990, the disclosure of which is totally incorporated herein by reference; and more specifically by selecting either a light lens optical system to discharge the nonimage areas or a laser when the information was in digital form. In addition, the photoreceptor process speed was about 2 inches per second.

Transfer efficiencies were obtained by measuring the amount of ink developed on the photoreceptor, and more specifically by imaging on the photoreceptor and subsequently wiping the ink therefrom with a sponge of a known weight. The increase in weight of the sponge was then measured, and thereafter the photoreceptor was imaged. This second image was then transferred to paper and the ink remaining on the photoreceptor after transfer to paper was measured using a sponge of a known weight. The percent transfer efficiency was then defined as the weight of ink transferred to paper by the weight of ink imaged on the photoreceptor, and the weight of ink imaged on the photoreceptor minus the weight of ink obtained from the weight gain of the sponge on the photoreceptor after transfer divided by the weight of ink images on the photoreceptor. Optical densities of the images were obtained using a Macbeth densitometer.

In all instances, when using the ink compositions of the present invention the images obtained were of excellent resolution, that is, no background deposits occurred, and further the ink particles were found to be neutral in polarity as determined by whether they were plated out on an electrode under the action of an electric field. As no particles plated out on either a negative or positive electrode after passing an electrical field through the ink, they are considered to be neutral.

EXAMPLE I

An ink composition containing 56.2 percent of Magiesol 60 oil, 22.5 percent Microlith CT, 16.9 percent Ganex V-216, 2.2 percent of Nuodex Copper Napthenate, and 2.2 percent of Aerosil 200 was prepared by placing the components in a Union Process 01 attritor, and attriting the material at room temperature, about 22° C., for 2 hours using ¼ inch diameter stainless steel balls. A dispersion with a viscosity of 240 centipoises was obtained. The primary particle average size diameter of the resulting ink was 0.2 micron, the resistivity was $10^{10}$ ohm-cm, and the ink particles were of a neutral polarity. Upon imaging, black images on 4024 paper with an optical density of 1.2 were obtained with a resolution of 4 to 6 line pairs per millimeter. The transfer efficiency from the photoreceptor to paper was found to be 82.5 percent, and the image dried within 45 seconds by absorption of the oil into the paper.

EXAMPLE II

An ink composition containing 56.2 percent of Magiesol 60 oil, 22.5 percent Microlith CT, 16.9 percent Ganex V-216, 2.2 percent Sulframin 1298, and 2.2 percent Aerosil 200 was formulated by placing these components in a polyethylene jar together with ¼ inch stainless steel balls, and milling these materials for 24 hours. An ink dispersion with a viscosity of 211 centipoises was obtained. The primary particle size diameter was 0.2 micron, and the resistivity of the ink was $5\times10^9$ ohm-cm with the ink particles being neutral in charge. Upon imaging onto Xerox 4024 paper, black images of an optical density of 1.2 with a resolution of 4 to 6 line pairs per millimeter were obtained. The transfer efficiency from the photoreceptor to paper was found to be 84 percent, and the image dried completely within 40 seconds by absorption into the paper.

EXAMPLE III

An ink composition containing 56.2 percent of Magiesol 60 oil, 22.5 percent Microlith CT, 16.9 percent Ganex V-216, 2.2 percent Witcamine AL-42, and 2.2 percent Aerosil 200 was prepared by attriting the above components in a Union Process 01 attritor for 2 hours. A conductive ink with a viscosity of 202 centipoises and a resistivity of $10^{10}$ ohm-cm was obtained. The primary particle size diameter of 0.15 micron for the resulting ink particles was measured by quasi-elastic light scattering; and the ink particles were essentially of a neutral polarity. Upon imaging onto Xerox 4024 paper, black images of an optical density of 1.2 were obtained with a resolution of 4 to 6 line pairs per millimeter. The transfer efficiency was found to be 80 percent and the image dried within 40 seconds.

EXAMPLE IV

An ink composition was prepared by repeating the procedure of Example I with the exception that Paraflex HT-10 was substituted for Magiesol 60. An ink of viscosity of 228 centipoises was obtained, which imaged and dried in a similar manner to the ink of Example I. The transfer efficiency of the ink was found to be 84 percent.

EXAMPLE V

An ink composition was prepared by repeating the procedure of Example II with the exception that Shellflex 210 was substituted for Magiesol 60. An ink of viscosity of 200 centipoises was obtained, which imaged in a similar manner to that illustrated in Example II. The transfer efficiency of this ink was found to be 81.5 percent.

EXAMPLE VI

An ink composition containing 64.1 percent Shellflex 270, 10.1 percent Printex 140V, 23.6 percent Ganex V-216, and 2.2 percent Witcamine AL-42 were attrited together in a Union Process 01 attritor for 2½ hours. An ink with a particle size diameter of 0.2 micron and a viscosity of 250 centipoises was obtained. The resistivity of this ink was $10^{10}$ ohm-cm with the ink particles being electrically neutral. Upon imaging, black images of an optical density of 1.2 were obtained, which dried within 45 seconds. The transfer efficiency from the photoreceptor to paper was 85 percent.

EXAMPLE VII

An ink composition was prepared by repeating the procedure of Example VI with the exception that Raven 5250 was substituted for Printex 140V. An ink of viscosity of 280 centipoises was obtained, which imaged to yield black images of an optical density of 1.2, and a transfer efficiency of 83.5 percent.

EXAMPLE VIII

An ink composition containing 9.7 percent of Lithol Scarlett, 7.6 percent OLOA 1200, 1.4 percent Vistanex LM-MH, 1.4 percent Bentone 500, 2.0 percent Witcamine AL-42, and 77.9 percent Magiesol 60 was prepared by ball milling the components in a polyethylene jar for 36 hours. An ink dispersion with a viscosity of 262 centipoises, and a particle size diameter of 0.52 micron was obtained. The particles were neutral in charge, and the resistivity of the dispersion was $6\times10^{10}$ ohm-cm. Upon imaging on Xerox 4024 paper, a cyan image of an optical density of 1.0 was obtained, which image dried in 45 seconds. The transfer efficiency of the ink was 84 percent.

EXAMPLE IX

An ink composition containing 10.0 percent of Printex 140V, 9.0 percent OLOA 1200, 0.5 percent Kraton G-1701, 2.0 percent Bentone 500, 0.5 percent Witcamine AL-42, and 78 percent Magiesol 60 was prepared by attriting these materials in a Union Process 01 attritor for 2 hours. An ink dispersion with a viscosity of 200 centipoises was obtained with a primary particle size diameter of 0.3 micron. The resistivity of this uncharged ink was $5.3\times10^{10}$ ohm-cm. Upon imaging on Xerox 4024 paper, a black image of an optical density of 1.2 was obtained with a resolution of 4 to 6 line pairs per millimeter, and the image dried within 40 seconds. The transfer efficiency of the ink was 86 percent.

EXAMPLE X

An ink composition was prepared by repeating the procedure of Example VIII with the exception that Sudan Blue OS was used in place of Lithol Scarlett. The viscosity of the ink dispersion was 238 centipoises, and the particle size diameter was 0.4 micron. The resistivity was $4.3\times10^{10}$ ohm-cm with the particles being electrically neutral. Upon imaging, cyan images with an optical density of 1.0 were obtained. The images dried within 50 seconds, and the transfer efficiency from the photoreceptor to paper was 84 percent.

EXAMPLE XI

An ink composition was prepared by repeating the procedure of Example VIII with the exception that Permanent Yellow FGL was used in place of Lithol Scarlett, and Sulframin 1298 was substituted for Witcamine AL-42. The viscosity of the ink dispersion was 252 centipoises, and the particle size diameter was 0.48 micron. The resistivity of the ink was $10^{10}$ ohm-cm with the particles being electrically neutral. Upon imaging onto 4024 paper, a yellow image with an optical density of 1.0 was obtained which dried within 45 seconds. The transfer efficiency of this ink was 88 percent.

EXAMPLE XII

An ink formulation containing 9.9 percent Printex 140V, 6.9 percent OLOA 1200, 1.4 percent Vistanex LM-MH, 1.0 percent Aerosil 300, 1.8 percent Witcamine AL-42, 40 percent Magiesol 60, and 39 percent Isopar M was prepared by attriting the above materials together in a Union Process 01 attritor for 2 hours. An ink dispersion with a viscosity of 248 centipoises was obtained. The ink particles were electrically neutral with a primary particle size diameter of 0.2 microns. The resistivity was $2\times10^{10}$ ohm-cm. Upon imaging onto Xerox 4024 paper, a black image of optical density of 1.2 was obtained, which dried within 45 seconds. The transfer efficiency of the ink from photoreceptor to paper was found to be 83 percent.

EXAMPLE XIII

An ink composition was prepared by repeating the procedure of Example XII with the exception that Hostaperm Pink E was used as the pigment instead of Printex 140V. An ink of viscosity 280 centipoises was found to image well. A cyan image of optical density of 0.9 was obtained. The transfer efficiency of the ink from photoreceptor to paper was found to be 80 percent.

EXAMPLE XIV

An ink composition was prepared by repeating the procedure of Example VI with the exception that Parabase was used in place of Shellflex 270. An ink dispersion of about 200 centipoises was obtained with a resistivity of about $10^{10}$ ohm-cm. The ink was found to image well onto Xerox 4024 paper giving a black image of optical density 1.2. The ink dried extremely rapidly, for example within 35 seconds, and exhibited a transfer efficiency of 85 percent.

Other modifications of the present invention will occur to those skilled in the art subsequent to a review of the present application. These modifications, and equivalents thereof are intended to be included within the scope of this invention.

What is claimed is:

1. A liquid developer composition comprised of an oil base selected from the group consisting of Magiesol, Witsol, Paraflex, Shellflex, Parabase, and Isopar, pigment particles, a stabilizer in an amount of from about 1 percent to about 40 percent by weight, and a surfactant in an amount of from about 0.5 percent to about 5 percent by weight that enables flocculation of the developer components, and efficient wetting of a photoreceptor surface.

2. A composition in accordance with claim 1 wherein the oil base is Magiesol 60.

3. A composition in accordance with claim 1 wherein the pigment is selected from the group consisting of carbon black, reinated carbon blacks, Printex, and Microlith CT.

4. A composition in accordance with claim 1 wherein the pigment particles are selected from the group consisting of cyan, magenta, yellow, and mixtures thereof.

5. A composition in accordance with claim 1 wherein the stabilizer is an alkylated polyvinyl pyrrolidone, poly(isobutylene-co-isoprene), Piccopole Ester 10, or poly(styrene-b-hydrogenated butadiene).

6. A composition in accordance with claim 1 wherein the oil base is present in an amount of from about 30 percent by weight to about 95 percent by weight, the pigment particles are present in an amount of from about 5 percent by weight to about 30 percent by weight, the stabilizer is present in an amount of from about 1 percent by weight to about 40 percent by weight, the surfactant is present in an amount of from about 0.5 percent by weight to about 5 percent by weight.

7. A composition in accordance with claim 1 with a transfer efficiency of from about 80 percent to about 95 percent.

8. A composition in accordance with claim 1 wherein the surfactant is Copper Napthenate, Sulframin, or Witcamine AL-42.

9. A composition in accordance with claim 1 further including therein viscosity additive particles.

10. A composition in accordance with claim 9 wherein the additive is Aerosil 200, Aerosil 300, or Bentone 500.

11. A composition in accordance with claim 10 wherein the pigment particles are selected from the group consisting of cyan, magenta, and yellow pigments, and mixtures thereof.

12. A composition in accordance with claim 10 with a transfer efficiency of from about 80 percent to about 95 percent is obtained in an electrostatographic apparatus.

13. A method of imaging which comprises the formulation of an image on a photoreceptor surface, subsequently contacting this image with a developer composition of claim 1, thereafter transferring the image to a suitable substrate, and permanently affixing the image thereto.

14. A method of imaging in accordance with claim 13 wherein there is selected for contacting the image a gravure roller.

15. A method of imaging in accordance with claim 14 wherein there results for the image a transfer efficiency of from about 80 percent to about 95 percent.

16. A method of imaging in accordance with claim 14 wherein the oil base is Magiesol 60.

17. A method of imaging in accordance with claim 1 wherein the pigment is selected from the group consisting of carbon black, resinated carbon blacks, Printex, and Microlith CT.

18. A method of imaging in accordance with claim 13 wherein the pigment particles are selected from the group consisting of cyan, magenta, yellow, and mixtures thereof.

19. A method of imaging in accordance with claim 13 wherein the stabilizer is an alkylated polyvinyl pyrrolidone, poly(isobutylene-co-isoprene), Piccopole Ester 10, or poly(styrene-bhydrogenated butadiene).

20. A method of imaging in accordance with claim 13 wherein the oil base is present in an amount of from about 30 percent by weight to about 95 percent by weight, the pigment particles are present in an amount of from about 5 percent by weight to about 30 percent by weight, the stabilizer is present in an amount of from about 1 percent by weight to about 40 percent by weight, the surfactant is present in an amount of from about 0.5 percent by weight to about 5 percent by weight.

21. A method of imaging in accordance with claim 13 with a transfer efficiency of from about 80 percent to about 95 percent.

22. A method of imaging in accordance with claim 13 wherein the surfactant is Copper Napthenate, Sulframin, or Witcamine AL-42.

23. A method of imaging in accordance with claim 13 further including therein viscosity additive particles.

24. A method of imaging in accordance with claim 23 wherein the additive is Aerosil 200, Aerosil 300, or Bentone 500.

25. A method of imaging in accordance with claim 24 wherein the pigment particles are selected from the group consisting of cyan, magenta, and yellow pigments, and mixtures thereof.

26. A method of imaging in accordance with claim 24 wherein a transfer efficiency of from about 80 percent to about 95 percent is obtained in an electrostatographic apparatus.

27. A composition in accordance with claim 1 wherein the developer possesses a resistivity of from about $10^9$ to about $10^{11}$ ohm-cm.

* * * * *